US005533267A

United States Patent [19]

Haight, Jr.

[11] Patent Number: 5,533,267

[45] Date of Patent: Jul. 9, 1996

[54] FLEXIBLE ONE-PIECE SCOPE RING

[76] Inventor: Sidney C. Haight, Jr., P.O. Box 247, Pittsfield, Pa. 16340

[21] Appl. No.: 396,767

[22] Filed: Mar. 1, 1995

[51] Int. Cl.[6] ..... F41G 1/387

[52] U.S. Cl. ..... 33/245; 33/233

[58] Field of Search ..... 33/245, 247, 248, 33/249, 233

[56] References Cited

U.S. PATENT DOCUMENTS

| | | | |
|---|---|---|---|
| 2,151,768 | 3/1939 | Humeston | 33/245 |
| 2,202,000 | 5/1940 | Gray | 33/245 |
| 2,427,784 | 9/1947 | Herkner | 33/245 |
| 2,436,948 | 3/1948 | Williams | 33/245 |
| 2,464,134 | 3/1949 | Hugg | 33/245 |
| 2,517,274 | 8/1950 | Baker et al. | 33/245 |
| 2,632,251 | 3/1953 | Weaver | 33/245 |
| 2,857,675 | 10/1958 | Kesselring | 33/245 |
| 3,037,288 | 6/1962 | Detrich et al. | 33/245 |
| 3,260,001 | 7/1966 | Weaver | 33/245 |
| 4,562,658 | 1/1986 | Govett | 33/245 |
| 4,959,908 | 10/1990 | Weyrauch | 33/245 |

*Primary Examiner*—Christopher W. Fulton
*Attorney, Agent, or Firm*—Lovercheck and Lovercheck

[57] ABSTRACT

A scope ring for a gun is made up of two clamping rings each having an integral stud. The studs and rings are each split. Two mounting blocks are to be mounted on the gun and each mounting block has a bore. The split studs are inserted in the bores and screws are inserted in the clamping blocks to clamp the block split studs and split mounting rings in place. The rings are made of thin resilient material with flat inside surfaces and curved outside surfaces having greatest thickness at their center and tapering outward to sharp side edges at their edges.

3 Claims, 1 Drawing Sheet

FLEXIBLE ONE-PIECE SCOPE RING

BACKGROUND OF THE INVENTION

The scope ring disclosed herein has spaced clamping rings that are supported on mounting blocks. The mounting blocks are attached to the gun. The clamping rings are in the form of split rings made of flexible resilient flat material and are relatively thin compared to their width. The inner surface of the rings that engages the telescope tube is flat so that it rests on the outside of the telescope tube. The outside surface of the clamping rings are arcuate and have a very small, relatively flat edge at each side. A radially extending stud is integrally attached to the scope ring forming a fastening means.

The rings and studs are split into two halves so that the stud halves and ring ends attached to the stud halves can be spread open to receive the telescope tube. The ends of the rings are then clamped together with the ring over the scope tube.

The curvature of the outside of the clamping rings terminates at flat edges avoids corners at its edges that would irritate the hand of the gunman. The curvature of the thin curved ring will also enhance the appearance of the ring and prevent the ring from being bent out of shape and distorted when closing the ring to assemble the scope tube in the rings.

The studs are split radially. The ring and stud halves spring open to assemble the scope tube in the rings. To assemble, the ends of the rings are forced together and both halves of the stud are inserted in a bore in the scope mounting blocks.

Applicant is aware of U.S. Pat. No. 3,187,435 to G. V. Miller, Jr., which discloses a scope mount having rings made of thick non-resilient material. Miller's rings are not intended to be spreadlike applicant's and Millers' rings do not terminate in flat edges. Applicant is also aware of an existing scope mount with rings made of thin resilient material that are rectangular in cross section that do not have the advantages of curvature and flat edges of applicant's rings.

SUMMARY OF THE INVENTION

It is an object of the present invention to provide an improved mount for a telescope sight on a gun.

Another object of the present invention to provide a scope ring made of relatively thin resilient material that has a flat inside surface and an arcuate outside surface joining the inside surface. Applicant has found that the thickness of this material should be about 0.045 inches for repeatability of opening and closing. Applicant has opened and closed one specimen 100 times with good results. Most will only be opened perhaps 2 to 4 times in their useful lives.

Another object of the present invention is to provide a scope ring that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
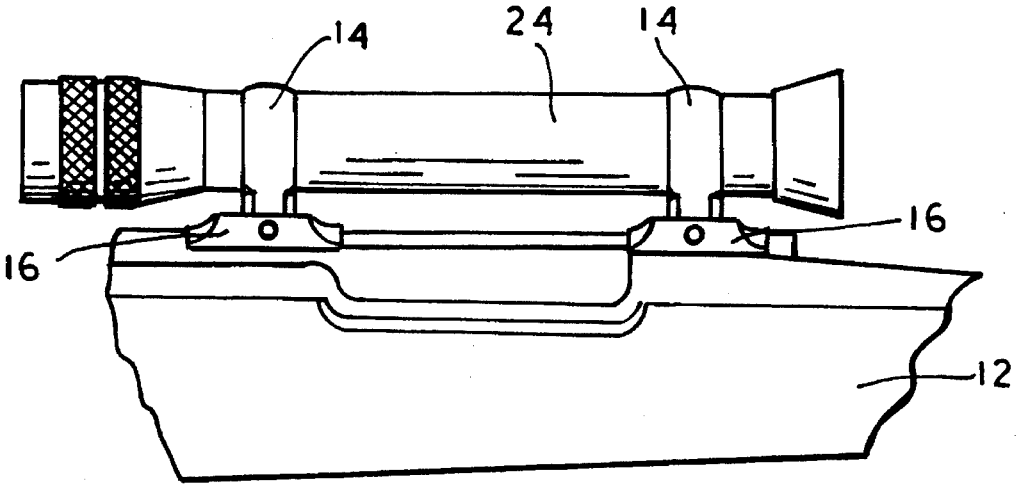
FIG. 1 is a side view of a scope mounted on a gun according to the invention.
Figure 2:
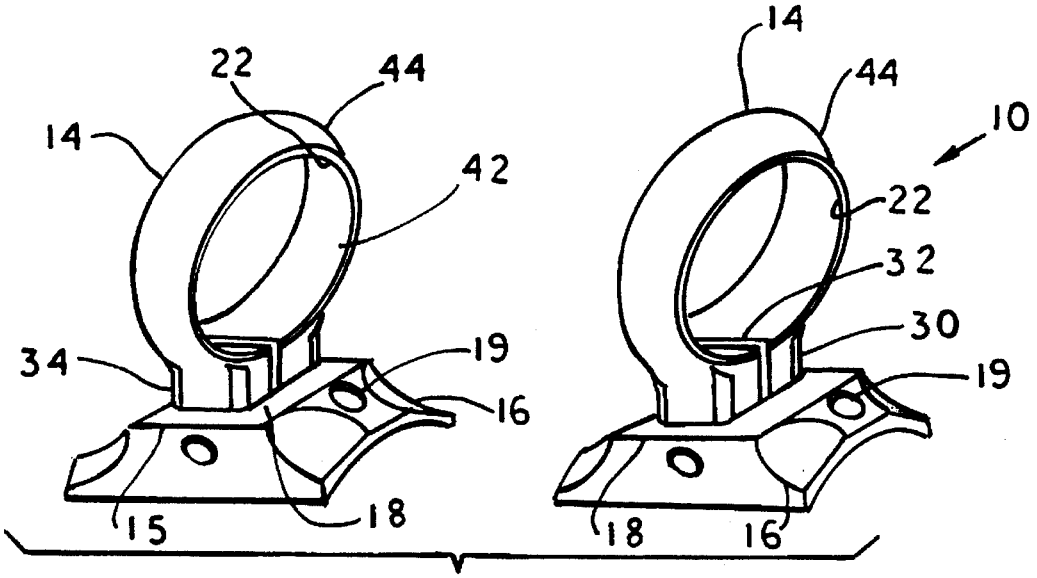
FIG. 2 is an exploded view of clamping rings and mounting blocks according to the invention.
Figure 3:
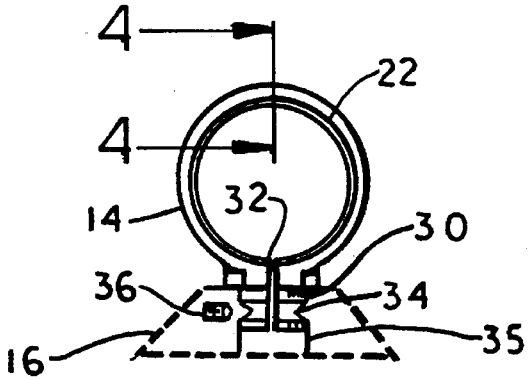
FIG. 3 is a front view of the clamping rings according to the invention.
Figure 4:
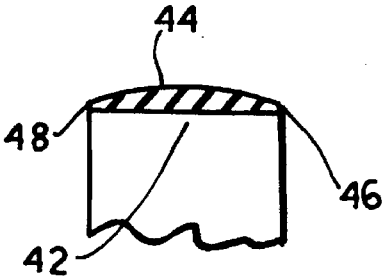
FIG. 4 is a cross sectional view of the clamping rings taken on line 4—4 of FIG. 3.

Now with more particular reference to the drawings, scope mount 10 for gun 12 is made up of two clamping rings 14 and two mounting blocks 16 that are attached to gun 12 by means of screws 19 that engages the holes in gun 12. Each mounting block 16 has top side 18 to be disposed adjacent scope mount 10 and bottom side 20 that rest on gun 12.

Each clamping rings 14 is made up of scope tube receiving ring members 22 made of flexible resilient material having flat inside surfaces 42 with an outer curved surface 44 that is arcuate and flat at its edges. Both rings 14 have thick part 31 and studs 30 integrally attached to ring members 22. Ring members 22, thick part 31 and studs 30 are split at slot 32 and studs 30 have peripheral groove 34 to receive the end of clamping screws 36.

Each clamping rings 14 may have an inside diameter large enough for the rings to fit over telescope tube 24. Clamping rings 14 for example, may be one half inch wide with very narrow thin edges 46,48. Clamping rings 14 have flat inside surfaces 42 and curved outer surfaces 47 in the form of an annular arch. Clamping rings 14 may be for example, 0.045 inches thick at its center and tapers to very narrow thin edges 46,48.

To install scope mount 10 on gun 12, mounting blocks 16 are first secured to gun 12 by screws 19. The ends of ring members 22 are then spread so that scope tube 24 will freely pass through ring members 22. The ends of ring members 22 are then squeezed together and studs 30 are mounted in vertical bores 35 in mounting blocks 16. Screws 19 are then tightened and scope mount 10 is ready for use.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A scope mount for a gun comprises two clamping rings and two mounting blocks;

each of said mounting blocks having a top side and a bottom side;

a vertical bore extends through each of said mounting blocks from said top side to said bottom side;

a lateral threaded bore in each of said mounting block extending from side to side;

each said clamping rings comprises scope receiving ring members and studs are integrally attached to each said ring-member and extending radially therefrom;

a slot extending through said studs and through said ring member;

said ring members each being made of a material that is relatively flat on the inside having very thin edges;

said material of said ring member being about 0.045 inches thick at its center and tapering outward to said thin edges;

said ring member has a cross sectional shape flat on the inside and arcuate on the outside.

2. The scope mount recited in claim 1 wherein said ring members are approximately 0.045 inches thick and have an outside curved surface.

3. A scope mount for a gun comprises two clamping rings and two mounting blocks;

each of said mounting blocks having a top side and a bottom side;

each of said clamping rings comprises scope receiving ring members;

said ring members each being made of thin flexible resilient material that is relatively flat on the inside having a thickened intermediate portion with thin edges;

said material of said ring members being about 0.045 inches thick at its center and tapering outward to said thin edges;

said ring members have a cross sectional shape flat on the inside and an arcuate outside surface;

a stud integrally attached to each said ring member;

a slot cut through each said ring member and each said stud dividing each said ring member and each said stud into two end portions; and, fastening means connected to said studs, clamping said two end portions together and to said mounting blocks;

said ring members are approximately 0.045 inches thick and have an outside curved surface.

* * * * *